US008894501B1

(12) United States Patent
Stillwagon

(10) Patent No.: US 8,894,501 B1
(45) Date of Patent: Nov. 25, 2014

(54) GOLF CLUB HEAD WITH LUMINESCENT ALIGNMENT ELEMENT

(71) Applicant: Woodrow C Stillwagon, Greenville, SC (US)

(72) Inventor: Woodrow C Stillwagon, Greenville, SC (US)

( * ) Notice: Subject to any disclaimer, the term of this patent is extended or adjusted under 35 U.S.C. 154(b) by 0 days.

(21) Appl. No.: 14/180,938

(22) Filed: Feb. 14, 2014

Related U.S. Application Data

(63) Continuation of application No. 13/861,535, filed on Apr. 12, 2013, now abandoned.

(60) Provisional application No. 61/797,677, filed on Dec. 13, 2012.

(51) Int. Cl.
*A63B 69/36* (2006.01)

(52) U.S. Cl.
CPC ..... *A63B 69/3685* (2013.01); *A63B 69/3632* (2013.01)
USPC ..... 473/220

(58) Field of Classification Search
USPC ..... 473/219, 220, 224, 226, 250, 325, 337, 473/340, 410
See application file for complete search history.

(56) References Cited

U.S. PATENT DOCUMENTS

| | | | | | |
|---|---|---|---|---|---|
| 4,695,055 | A * | 9/1987 | Newcomb et al. | ..... | 473/200 |
| 4,749,196 | A * | 6/1988 | Podgor | ..... | 473/250 |
| 4,913,437 | A * | 4/1990 | Newcomb et al. | ..... | 473/220 |
| 5,029,868 | A * | 7/1991 | Cloud | ..... | 473/220 |
| 5,169,150 | A * | 12/1992 | Tindale | ..... | 473/220 |
| 5,240,253 | A * | 8/1993 | Cooper | ..... | 473/236 |
| 5,482,283 | A * | 1/1996 | Wall | ..... | 473/220 |
| 5,733,202 | A * | 3/1998 | Vargo | ..... | 473/220 |
| 6,001,031 | A * | 12/1999 | San Juan | ..... | 473/340 |
| 7,112,151 | B2 * | 9/2006 | Adams | ..... | 473/409 |
| 2002/0019264 | A1 * | 2/2002 | Buchanan | ..... | 473/305 |
| 2004/0092327 | A1 * | 5/2004 | Marnocha | ..... | 473/220 |

* cited by examiner

*Primary Examiner* — Nini Legesse
(74) *Attorney, Agent, or Firm* — Smith Moore Leatherwood LLP; Thomas W. Epting; John P. Zimmer

(57) ABSTRACT

In one aspect, golf club heads are described herein. A golf club head described herein can comprise a hitting face, a heel positioned behind the hitting face, a top positioned between the hitting face and the heel, and a luminescent component, wherein the luminescent component is positioned to project a spot of light onto a golf ball at a point on the golf ball tangent to the hitting face of the club head and aligned with the center of the hitting face of the club head.

16 Claims, 4 Drawing Sheets

GOLF CLUB HEAD WITH LUMINESCENT ALIGNMENT ELEMENT

CROSS REFERENCE TO RELATED APPLICATIONS

This application is a continuation of U.S. patent application Ser. No. 13/861,535 filed on Apr. 12, 2013, which claims priority to U.S. Provisional Patent Application No. 61/797,677 filed Dec. 13, 2012, which are each incorporated herein by reference in their entireties.

FIELD OF INVENTION

The present invention combines long evolved putter club design, but not limited to, with a modem optically enhance plastic to help better align the club and focus on the ball during the putting stroke of a golfer. The teachings of this invention are applicable to the design of all golf clubs.

BACKGROUND OF THE INVENTION

Golf is frequently referred to as being a 'game that is 50% fun and 50% putting'. Typically it takes 1, 2, 3 and sometime more shots (strokes) to hit your golf ball from the tee to the putting green. The golfer tries to hit the ball as far as possible between the golf tee and the putting green. However, once the ball is on the green (putting surface), the skilled golfers will then try to limit the number of strokes on the green to 1 or 2 putts. On the green the emphasis is different; the golfer needs to focus on accurately aiming and stroking of the golf ball.

Helping the golfer to better aim his putt, all putting clubs have some type of alignment means included on top of the club head of the putter. This alignment means could include a black or white line, a scribed line, series white discs, a notch, a slot et cetera on the top surface of the club. These alignment means usually extend from the front of the hitting surface to the back of the club.

Before the golfer approaches the ball to putt, many golfers first "mark" the ball and reposition the ball in such a way that the ball's name or a scribed reference line can be used as a reference to help aim the putt with the face of the putter. Because the golfer must stoop to place the ball on the ground, it is difficult to accurately reposition and align the ball. After the ball has been repositioned, the golfer places his putter behind the ball and tries to align the ball's name or scribed reference line and the centerline markings on the club head. Commonly there is a little misalignment between the ball and the putter alignment means. Usually, the golfer favors the club alignment means over the positioning of the golf ball. Unfortunately, choosing the putter for alignment distracts the golfer's attention away from focusing on the golf ball to focusing on the putter's club head. Good putters don't focus on the putter head. Both teaching and playing professional golfers overwhelmingly favor 4:1 the need to concentrate the golfer's attention on the ball over focusing on the club head to be a successful putter.

BRIEF DESCRIPTION OF THE INVENTION

This invention transforms the putter into becoming an interactive element in the putting process. Imbedding a colored, transparent polymer like Acrilex's Fluorescent, Edge Color and LISA Acrylic plastics or ComPlex Plastics' Fluorescent Edge Acrylic plastic, but not limited to, creates a light emitting source that highlights the club's centerline and helps align the putter. At the same time, the Acrylic plastic projects a glowing halo forward on the circumference of the golf ball that is tangent to the putter's face. The optically brightened Acrylic plastic element is sandwiched or embedded along the centerline and/or across the face of the putter between the front hitting area and the club's heal. It is desirable that all or a portion of the brightened plastic element be exposed to visible light. The fluorescence of the plastic element is governed by the laws of geometric optics and light refraction. When light passes from a medium of high optical density to a medium of lower optical density, only a small portion of the fluorescent light can be emitted at the interface between the plastic and air. Most of the light is repeatedly reflected back and forth inside the material. The trapped light can emerge most effectively through the exposed narrow and/or beveled edge of material. A portion of the light trapped between the flat surfaces can be deflected through the opposing flat surface by the application of a reflective coating on the first flat surfaces. The same application of a reflective coating can be used to amplify edge brightness.

The Acrylic insert can be cast, thermoformed, mechanically cut, drilled, routed, laser cut, bonded, wedged, riveted, press fit, and glued to complement the unique physical design of the club head. The luminescence of the Acrylic element can be amplified, a portion of the surface may be printed, hot stamped, scribed, beveling or silk screened. Choice of the Acrylic element's color can complement the best color acuity of golfer.

The golfer, when using the interactive guidance system, places his putter directly behind the ball. Sighting the luminated Acrylic plastic line on the top edge of the putter, the golfer then positions the putter to aim striking the ball on the trajectory the golfer believes will best to stroke the ball and make the putt. The same luminated Acrylic line that facilitates putter alignment projects a forward glow from its face on the golf ball that is tangent to the club. The light halo that is created on the ball is most intense at the optimal point of contact when being stroked by the putter. The luminated point of contact on the ball now becomes the center of focus for the golfer about to strike his putt. The point of contact momentarily imprints the mind of the golfer and the focus of the putting stroke. Shifting the golfer's focus to the golf ball will improve alignment and putt accuracy.

In applications where traditional putt alignment methods are preferred, a single or double bevel undercut on the backside of the Acrylic plastic club face insert will project a luminated halo on the optimal point of contact on the golf ball for stroking a putt.

The alignment and highlighting optimal contact point teachings disclosed are not limited to the putter and can be usefully adapted to other golf clubs like irons, woods and a hybrid clubs.

DETAILED DESCRIPTION OF THE INVENTION

The present invention seeks to help the golfer improve putting performance by better alignment of the putt and highlighting the point of contact on the golf ball. The Acrylic element in the club head that highlights the golf ball collects and/or absorbs light from their surroundings, conducting it within the material and re-emitting a greatly amplified of the light in a concentrated form at its edge. The majority of the illustrations demonstrate the critical interaction between the putter and the golf ball.

Figure 1:
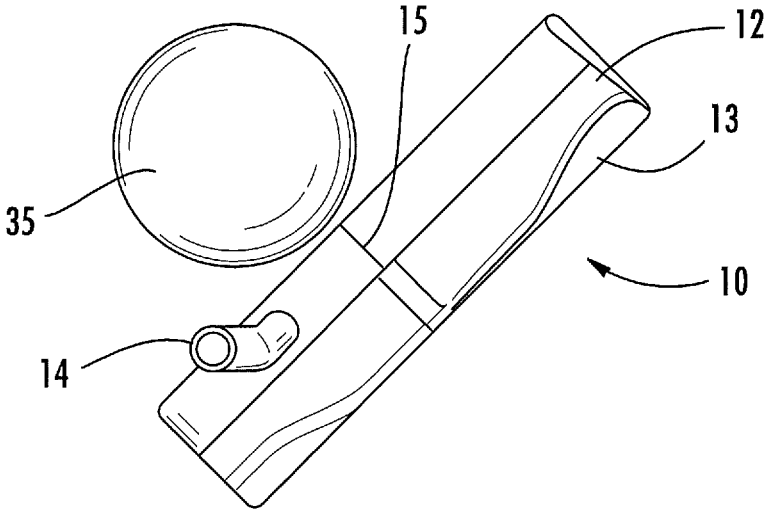
FIG. 1 illustrates a generic putter and golf ball.
Figure 1A:
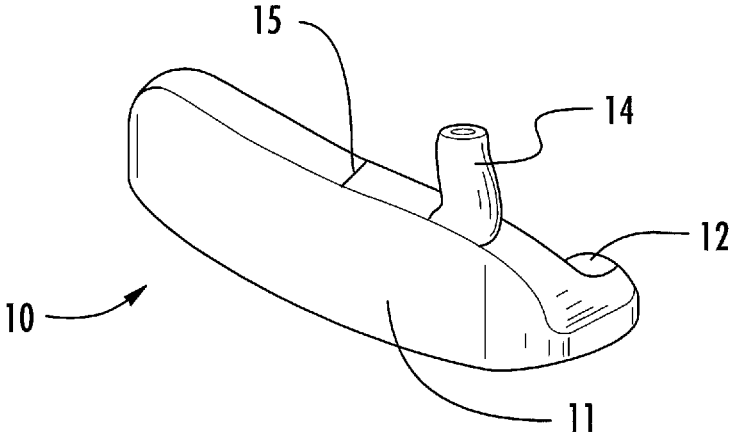
FIG. 1*a* illustrates a front view of a generic putter.

As a point of reference, FIG. 1 depicts a typical Putter 10, with its Putter Top 12, Putter Heal 13, Putter Rosel 14, Putter Center Line 15. In the putting process, the golfer tries to align the Putter Center Line 15 with the Golf Ball 35. Best putting results occur when the Putter Center Line 15 is tangent with the Golf Ball 35. Currently, the golfer must proximate the tangent alignment between the Putter Center Line 15 and the Golf Ball 35. FIG. 1 *a* provides a prospective front view of the Putter Face 11, Putter Top 12 with its Putter Rosel 14 and Putter Center Line 15.

Figure 2:
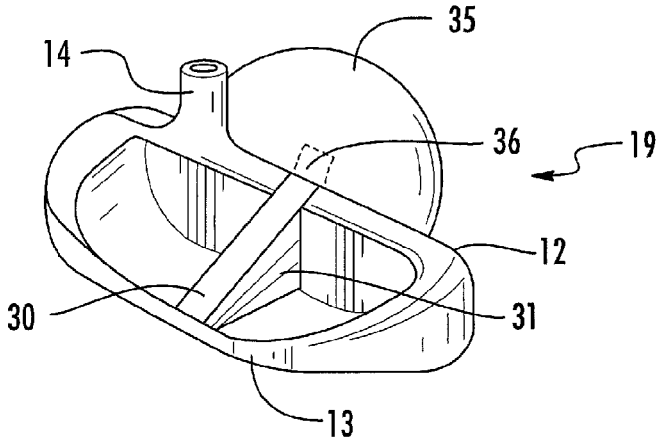
FIG. 2 illustrates an insert modified putter and golf ball.
Figure 2A:
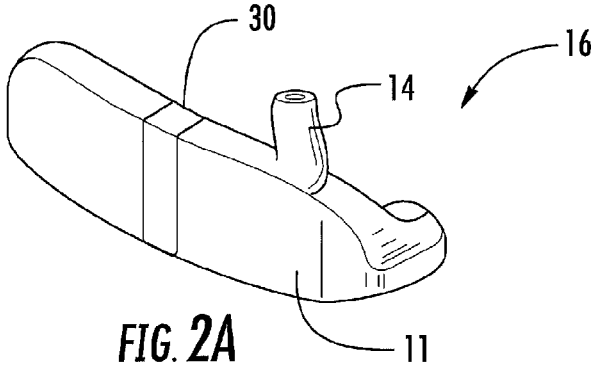
FIG. 2*a* illustrates a front view of a bifurcated putter.
Figure 2B:
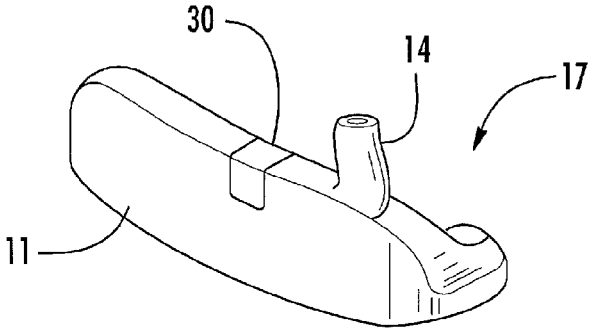
FIG. 2*b* illustrates a front view of a putter with partial insert.

FIG. 2 depicts a Modified Putter 19 with its Putter Top 12, Putter Heal 13, and Putter Rosel 14 that has been upgraded with Highlighted Surface 30 and Light Adsorbing Surface 31. Light is captured by the Light Adsorbing Surface 31, it is amplified and projected from the exposed edges of the Highlighted Surface 30. The intensified light emitted from the Highlighted Surface 30 strikes tangentially the Golf Ball 35 and Spotlights Ball 36. FIG. 2*a* depicts a front prospective view of a Bifurcated Putter 16 with its Putter Face 11, Putter Rosel 14 that has been upgraded with Highlighted Surface 30. The full height Highlighted Surface 30 will project light tangentially on the Golf Ball 35 (not shown). FIG. 2*b* shows a front prospective view of a partial Insert Mount Putter 17 with its Putter Face 11, Putter Rosel 14 that has been upgraded with Highlighted Surface 30. The truncated Highlighted Surface 30 projects light tangentially on the Golf Ball 35 (not shown).

Figure 3:
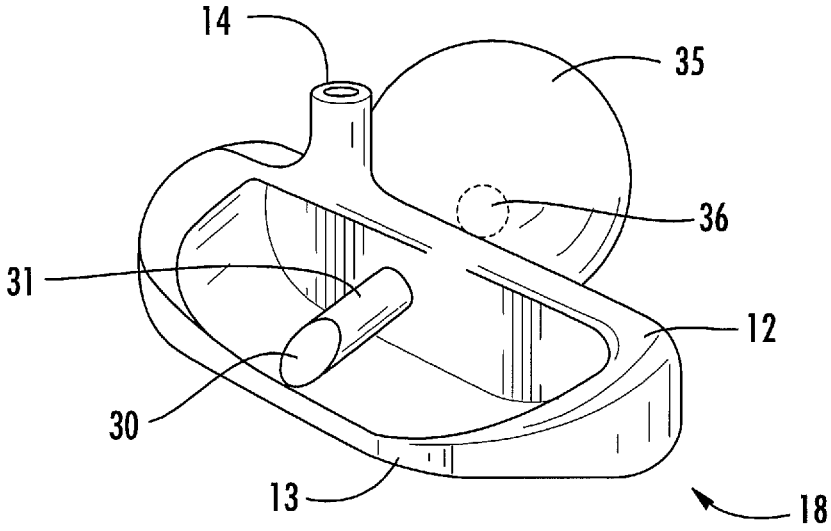
FIG. 3 illustrates a through hole modified generic putter with golf ball.
Figure 3A:
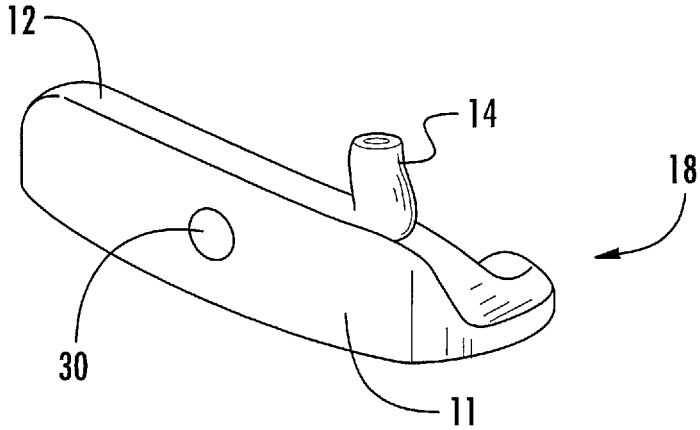
FIG. 3*a* illustrates a front view of a thru hole generic putter.

FIG. 3 depicts a Rod Modified Putter 18 with its Putter Top 12, Putter Heal 13, and Putter Rosel 14 that has been upgraded with a rod shaped element that has the Highlighted Surface 30 and Light Adsorbing Surface 31. The emitted light from the Highlighted Surface 30 luminates tangentially the Golf Ball 35 (Highlighted Golf Ball 36). Likewise, FIG. 3*a* shows a front prospective view a Rod Modified Putter 18 with its Putter Face 11, Putter Top 12, and Putter Rosel 14 with its rod Highlighted Surface 30

Figure 4:
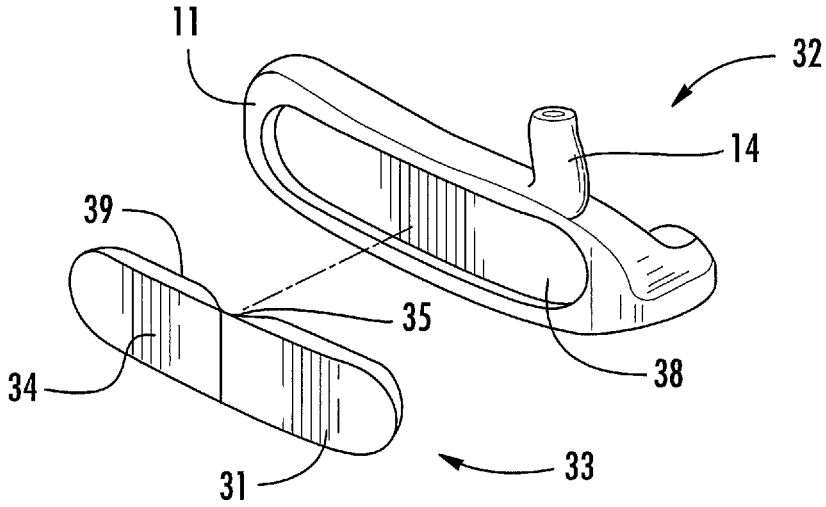
FIG. 4 illustrates a generic putter head with a beveled face insert.

The Putter Head 32 in FIG. 4 depicts a putter head with its Putter Face 11, Putter Rosel 14, and Insert Recess 38 that will accept the Putter Insert 33. The Putter Insert 33 has a Light Adsorbing Surface 31, a Reverse 'V' Notch 35, a Forward Projecting Highlighted Surface 34, and a Reverse Attachment Surface 39. Selectively, the vertical Reverse 'V' Notch 35 can be partial or full length to create the Forward Projecting Highlighted Surface 34 within the Putter Insert 33. The Forward Projecting Highlighted Surface 34 will luminate a focus point for the golfer to concentrate on that is tangent to the club on the golf ball (not shown).

The illustrated examples are offered by way of illustration of the invention's versatility and not meant to limit the invention in any way. The present invention may be embodied in other forms without departing from its spirit of essential characteristic. The described embodiments are to be considered in all respects only illustrative and not restrictive. The scope of the invention is therefore indicated by the appended claims rather than the foregoing descriptions. All changes which come within the meaning and scope of equivalency of the claims are to be embraced within their scope.

The invention claimed is:

1. A golf club head comprising:

a hitting face;

a heel positioned behind the hitting face;

a top positioned between the hitting face and the heel; and a luminescent component, wherein the luminescent component is positioned to project a spot of light onto a golf ball at a point on the golf ball tangent to the hitting face of the club head and aligned with the center of the hitting face of the club head;

wherein the luminescent component defines a centerline on the to of the golf club head generally perpendicular to the hitting face and extending between the hitting face and the heel; and wherein the luminescent component comprises a fluorescent polymeric component.

2. The golf club head of claim 1, wherein the luminescent component projects light from the centerline.

3. The golf club head of claim 1, wherein the luminescent component defines a centerline vertically on the hitting face of the golf club head.

4. The golf club head of claim 1, wherein the luminescent component bifurcates the golf club head.

5. The golf club head of claim 1, wherein the luminescent component is disposed on the top of the golf club head.

6. The golf club head of claim 1, wherein the luminescent component penetrates the golf club head.

7. The golf club head of claim 1, wherein the luminescent component is at least partially embedded in the hitting face.

8. The golf club head of claim 7, wherein the luminescent component defines a generally circular luminescent surface on the hitting face.

9. The golf club head of claim 1, wherein the luminescent component comprises a fluorescent acrylic plastic element.

10. The golf club head of claim 9, wherein:

the fluorescent acrylic plastic element includes a light absorbing surface and an edge; and the fluorescent acrylic plastic element projects light from the edge of the fluorescent acrylic plastic element.

11. The golf club head of claim 9, wherein the fluorescent acrylic plastic element comprises a rod shaped element.

12. The golf club head of claim 1, wherein the luminescent component projects a spot of light of a color complementing the best visual acuity of a golfer using the golf club head.

13. The golf club head of claim 1, wherein the golf club head is a putter head.

14. The golf club head of claim 1, wherein the golf club head is a wood, iron, or hybrid golf club head.

15. A golf club head comprising:

a hitting face;

a heel positioned behind the hitting face;

a top positioned between the hitting face and the heel; and a luminescent component, wherein the luminescent component is positioned to project a spot of light onto a golf ball at a point on the golf ball tangent to the hitting face of the club head and aligned with the center of the hitting face of the club head;

wherein the hitting face defines an insert recess and an insert disposed in the insert recess of the golf club head;

wherein the luminescent component is at least partially embedded in the insert; and wherein the luminescent component comprises a fluorescent polymeric component.

16. The golf club head of claim 15, wherein the insert comprises a beveled notch adjacent the insert recess, and the beveled notch is configured to permit absorption of light by the luminescent component in between the hitting face and the insert recess of the golf club head.

* * * * *